US007710382B2

(12) United States Patent
Park et al.

(10) Patent No.: US 7,710,382 B2
(45) Date of Patent: May 4, 2010

(54) DISPLAY DEVICE AND DRIVING APPARATUS THEREOF

(75) Inventors: Jheen-Hyeok Park, Seongnam-si (KR); Sun-Kyu Son, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 857 days.

(21) Appl. No.: 11/082,561

(22) Filed: Mar. 17, 2005

(65) Prior Publication Data

US 2005/0206605 A1 Sep. 22, 2005

(30) Foreign Application Priority Data

Mar. 18, 2004 (KR) ..... 10-2004-0018426

(51) Int. Cl.
*G09G 3/36* (2006.01)

(52) U.S. Cl. ..... 345/100; 345/205; 345/698; 349/139; 349/149; 324/537; 324/538

(58) Field of Classification Search ..... 345/87, 345/92, 93, 98, 100, 204–206, 698, 699; 349/139, 149–152; 324/537, 538
See application file for complete search history.

(56) References Cited

U.S. PATENT DOCUMENTS

| | | | | |
|---|---|---|---|---|
| 5,594,463 | A * | 1/1997 | Sakamoto | 345/76 |
| 5,945,984 | A * | 8/1999 | Kuwashiro | 345/206 |
| 6,335,720 | B1 * | 1/2002 | Mori et al. | 345/98 |
| 6,476,789 | B1 * | 11/2002 | Sakaguchi et al. | 345/100 |
| 6,504,523 | B1 * | 1/2003 | Sugawara et al. | 345/98 |
| 6,590,559 | B2 * | 7/2003 | Takabayashi et al. | 345/99 |
| 7,038,675 | B2 * | 5/2006 | Kawamura et al. | 345/211 |
| 7,256,759 | B2 * | 8/2007 | Kim et al. | 345/87 |

* cited by examiner

*Primary Examiner*—Henry N Tran
(74) *Attorney, Agent, or Firm*—Cantor Colburn LLP

(57) ABSTRACT

A driving circuit according to an embodiment of the present invention includes an input terminal, unit circuits connected to the input terminal, and output terminals electrically connected to the input terminals. Each of the unit circuits is enabled in response to a control signal inputted via the input terminal.

9 Claims, 9 Drawing Sheets

DISPLAY DEVICE AND DRIVING APPARATUS THEREOF

BACKGROUND OF THE INVENTION (a) Field of the Invention

The present invention relates to a device for displaying images, and more particularly to, a device for driving an image display device having the same.

(b) Description of Related Art

In a panel assembly of a display device, gate lines and data lines are provided in a row direction and in a column direction, respectively, and pixel circuits are provided which are connected to the gate and data lines via switching elements such as thin film transistors. The switching elements transmit data signals transmitted via the data lines to pixel electrodes responsive to gate signals transmitted via the gate lines. The gate signals are formed by gate driving integrated circuits (ICs), which receive and synthesize a gate-on voltage and a gate-off voltage from an external device in response to a signal controller. The data signals are acquired by data driving ICs' converting digital image signals from the signal controller into analogue data voltages.

The signal controller etc. is generally provided on a printed circuit board (PCB) positioned external to the panel assembly and the driving ICs are mounted on a flexible printed circuit film (FPC) disposed between the PCB and the panel assembly or on the panel assembly.

As described above, a number and kind of the driving ICs mounted on the FPC or the panel assembly generally may be varied depending on a resolution of the display device. In other words, since a number of the gate and data lines formed on the panel assembly may be varied depending on the resolution of the display device, dedicated driving ICs are used which have a predetermined number of pins depending on the resolution.

Therefore, since the driving ICs are designed and manufactured depending on a predetermined specification relating to the resolution of the display device, kinds of the driving ICs increase and accordingly manufacturing cost and time also increase. Thus, there is a need to develop a versatile driving IC which may be used in display devices having varied resolutions.

SUMMARY OF THE INVENTION

An object of the present invention is to provide a driving IC used irrespective of a resolution of a display device. Another object of the present invention is to reduce developing cost and time of a display device.

A driving circuit is provided which includes an input terminal, unit circuits connected to the input terminal, and output terminals electrically connected to the input terminal. Each of the unit circuits is enabled in response to a control signal inputted via the input terminal.

A display device is provided, which includes gate lines transmitting gate-on voltages, data lines intersecting the gate lines and transmitting data voltages, pixels comprising switching elements, a gate driver connected to the gate lines and applying the gate-on voltages to the data lines, a data driver connected to the data lines and applying the data voltages to the data lines, and a signal controller configured to control the gate driver and the data driver. Each of the switching elements is connected to one of the gate lines and one of the data lines and turned on by the gate-on voltages and arranged in a matrix. The data driver is supplied with a data pin selecting signal and comprises output terminals connected to the data lines, and the data driver changes a number of output terminals outputting the data voltages in response to the data pin selecting signals.

A state of the data pin selecting signal may be altered in response to a resolution of the display device.

A display device is provided, which includes a data driving integrated circuit and a panel assembly. The data driving integrated circuit has a first input pin for input of a control signal, second input pins for input of image data and output pins for output of data voltages corresponding to the image data. The panel assembly is provided with data lines electrically connected to a portion of the output pins, gate lines intersecting the data lines and switching elements connected to the data lines and the gate lines. A number of the output pins of the data driving integrated circuit is larger than a number of the data lines.

BRIEF DESCRIPTION OF THE DRAWINGS

The present invention will become more apparent by describing embodiments thereof in detail with reference to the accompanying drawings in which.

DETAILED DESCRIPTION OF THE INVENTION

Figure 1:
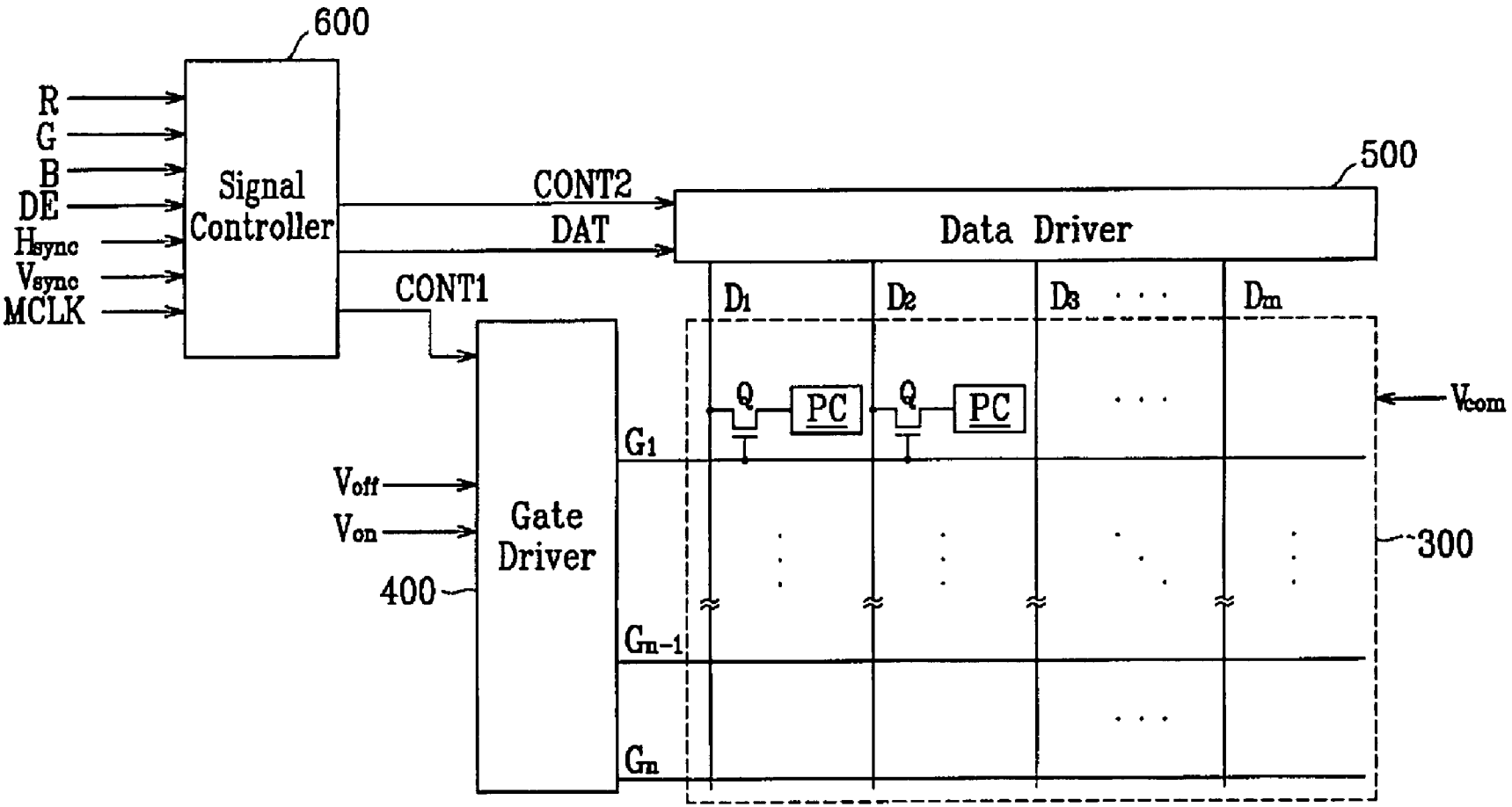
FIG. 1 is a block diagram of a display device according to an exemplary embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein.

In the drawings, the thickness of layers and regions are exaggerated for clarity. Like numerals refer to like elements throughout. It will be understood that when an element such as a layer, film, region, substrate or panel is referred to as being "on" another element, it can be directly on the other element or intervening elements may also be present. In contrast, when an element is referred to as being "directly on" another element, there are no intervening elements present.

Figure 2:
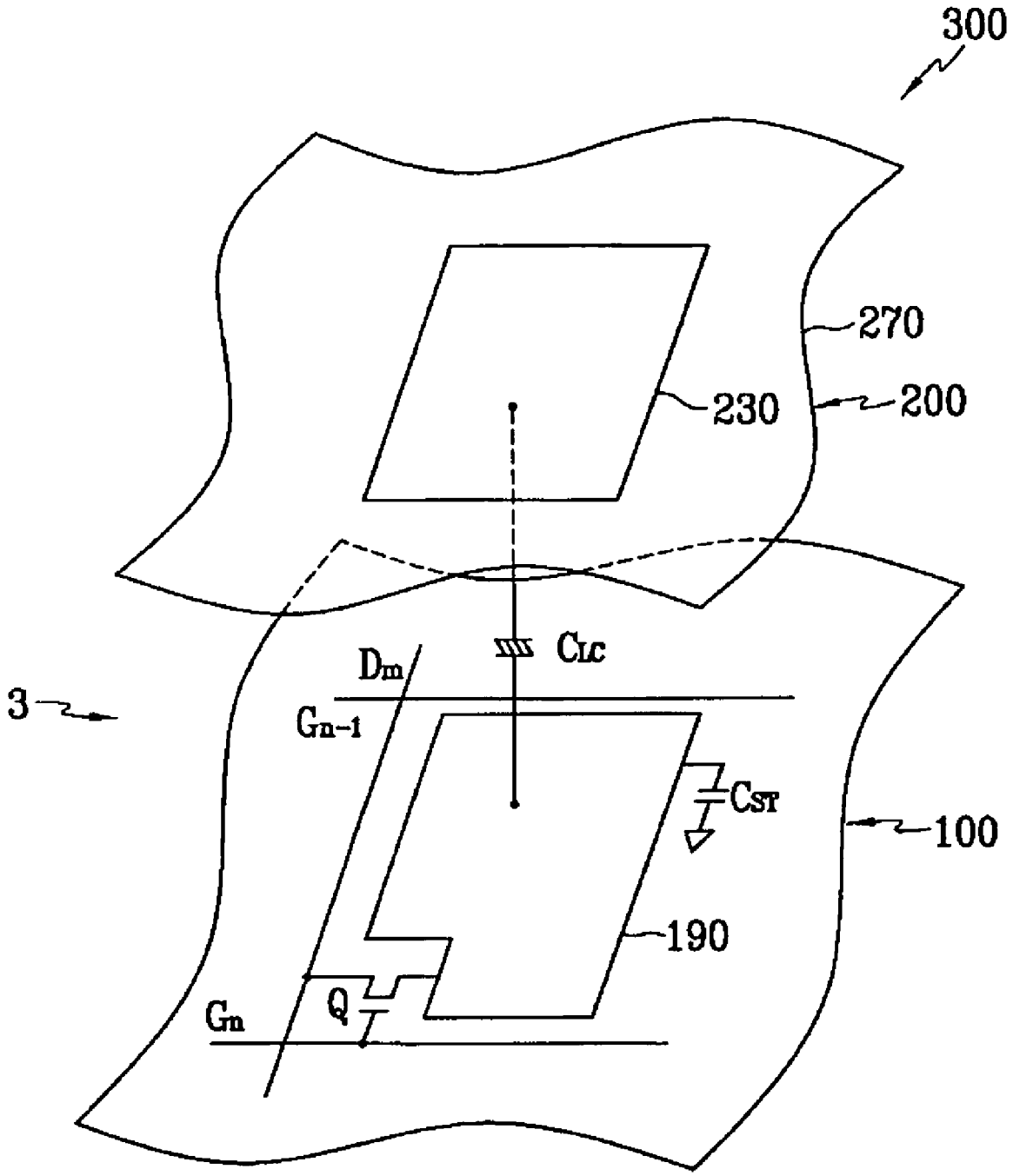
FIG. 2 illustrates a structure and an equivalent circuit diagram of a pixel of a liquid crystal display (LCD) according to an exemplary embodiment of the present invention.

FIG. 1 is a block diagram of a display device according to an exemplary embodiment of the present invention, and FIG. 2 illustrates a structure and an equivalent circuit diagram of a pixel of a liquid crystal display (LCD) according to an exemplary embodiment of the present invention.

Referring to FIG. 1, a display device according to an exemplary embodiment of the present invention includes a panel assembly 300, a gate driver 400 and a data driver 500 which are electrically connected to the panel assembly 300, and a signal controller 600 controlling the gate driver 400 and the data driver 500.

As shown in FIG. 1, the panel assembly 300 includes a plurality of display signal lines $G_1$-$G_n$ and $D_1$-$D_m$ and a plurality of pixels connected to the display signal lines $G_1$-$G_n$ and $D_1$-$D_m$. The pixels are, for example, and arranged substantially in a matrix.

In a structural view as shown in FIG. 2, the panel assembly 300 includes a lower panel 100, an upper panel 200 facing the lower panel 100, and a liquid crystal (LC) layer 3 disposed between the lower and upper panels 100 and 200.

The display signal lines $G_1$-$G_n$ and $D_1$-$D_m$ are provided on the lower panel 100 and include gate lines $G_1$-$G_n$ transmitting gate signals (called scanning signals) and data lines $D_1$-$D_m$ transmitting data signals. The gate lines $G_1$-$G_n$ extend substantially in a row direction and are substantially parallel to each other, while the data lines $D_1$-$D_m$ extend substantially in a column direction and are substantially parallel to each other.

Each of the pixels includes a switching element Q connected to one of the gate lines $G_1$-$G_n$ one of the data lines $D_1$-$D_m$, and a pixel circuit PC. The switching element Q, for example, a thin film transistor, has three terminals: a control terminal connected to one of the gate lines $G_1$-$G_n$; an input terminal connected to one of the data lines $D_1$-$D_m$; and an output terminal connected to the pixel circuit PC.

As shown in FIG. 2, in a representative flat panel display such as an LCD, the panel assembly 300 includes the lower panel 100 and the upper panel 200 and the LC layer 3 interposed therebetween, and the display signal lines $G_1$-$G_n$ and $D_1$-$D_m$ and the switching element Q are provided on the lower panel 100. The pixel circuit PC of the LCD includes LC capacitor $C_{LC}$ and a storage capacitor $C_{ST}$. The storage capacitor $C_{ST}$ may be omitted if there is no need for the storage capacitor $C_{ST}$.

The LC capacitor $C_{LC}$ includes a pixel electrode 190 on the lower panel 100, a common electrode 270 on the upper panel 200, and the LC layer 3 as a dielectric between the pixel and common electrodes 190 and 270. The pixel electrode 190 is connected to the switching element Q, and the common electrode 270 covers the entire surface of the upper panel 200 and is supplied with a common voltage $V_{com}$. Alternatively, both the pixel electrode 190 and the common electrode 270, which have shapes of bars or stripes, are provided on the lower panel 100.

The storage capacitor $C_{ST}$ is an auxiliary capacitor for the LC capacitor $C_{LC}$. The storage capacitor $C_{ST}$ includes the pixel electrode 190 and a separate signal line (not shown), which is provided on the lower panel 100, overlaps the pixel electrode 190 via an insulator, and is supplied with a predetermined voltage such as the common voltage $V_{com}$. Alternatively, the storage capacitor $C_{ST}$ includes the pixel electrode 190 and an adjacent gate line called a previous gate line, which overlaps the pixel electrode 190 via an insulator.

For a color display, each pixel uniquely represents one of three primary colors such as red, green and blue (R, G and B) colors (spatial division) or sequentially represents the three primary colors in time (temporal division), thereby obtaining a desired color. FIG. 2 shows an example of the spatial division in which each pixel includes a color filter 230 representing one of the three primary colors in an area of the upper panel 200 facing the pixel electrode 190. Alternatively, the color filter 230 is provided on or under the pixel electrode 190 on the lower panel 100. A pair of polarizers (not shown) are attached on outer surfaces of the upper panel 200 and the lower panel 100.

Referring back to FIG. 1, the gate driver 400 is connected to the gate lines $G_1$-$G_n$ of the panel assembly 300 and synthesizes the gate-on voltage $V_{on}$ and the gate-off voltage $V_{off}$ from a driving voltage generator (not shown) to generate gate signals for application to the gate lines $G_1$-$G_n$, and may be comprised of a plurality of ICs. The data driver 500 is connected to the data lines $D_1$-$D_m$ of the panel assembly 300 and applies data voltages to the data lines $D_1$-$D_m$, and may comprise a plurality of integrated circuits (ICs).

Respective gate driving ICs or data driving ICs may be mounted on a flexible printed circuit film (FPC) in a chip type to be attached to the panel assembly 300, or directly mounted on the panel assembly 300 (chip on glass (COG) type). Alternatively, a circuit performing the same function as the IC may be integrated together with the thin film transistor on the panel assembly 300. The signal controller 600 controls the gate driver 400 and the data driver 500.

A structure of a driving IC according to an exemplary embodiment of the present invention will be described further with reference to FIGS. 3 and 4.

Figure 3:
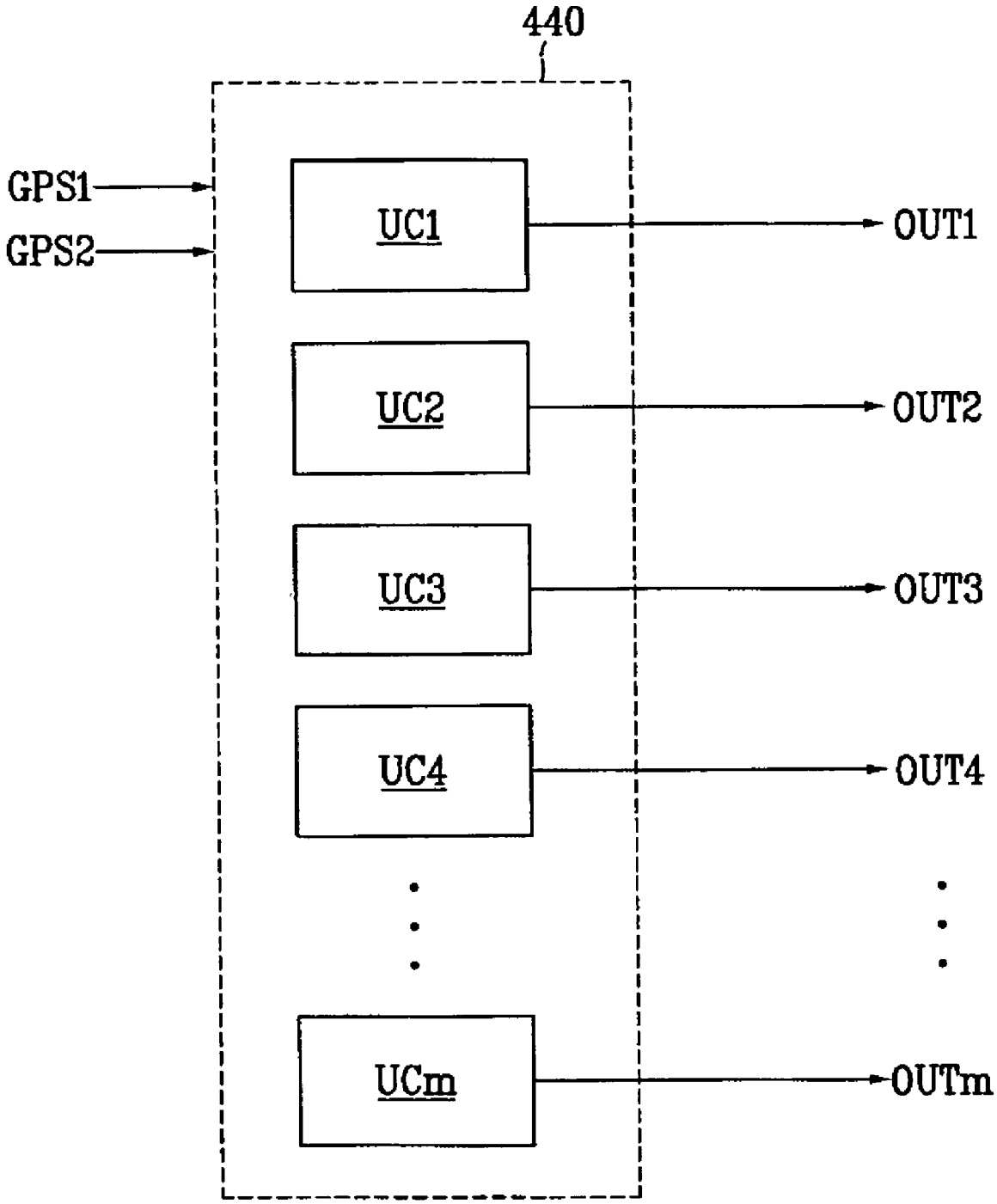
FIG. 3 is a block diagram of a gate driving IC according to an exemplary embodiment of the present invention.
Figure 4:
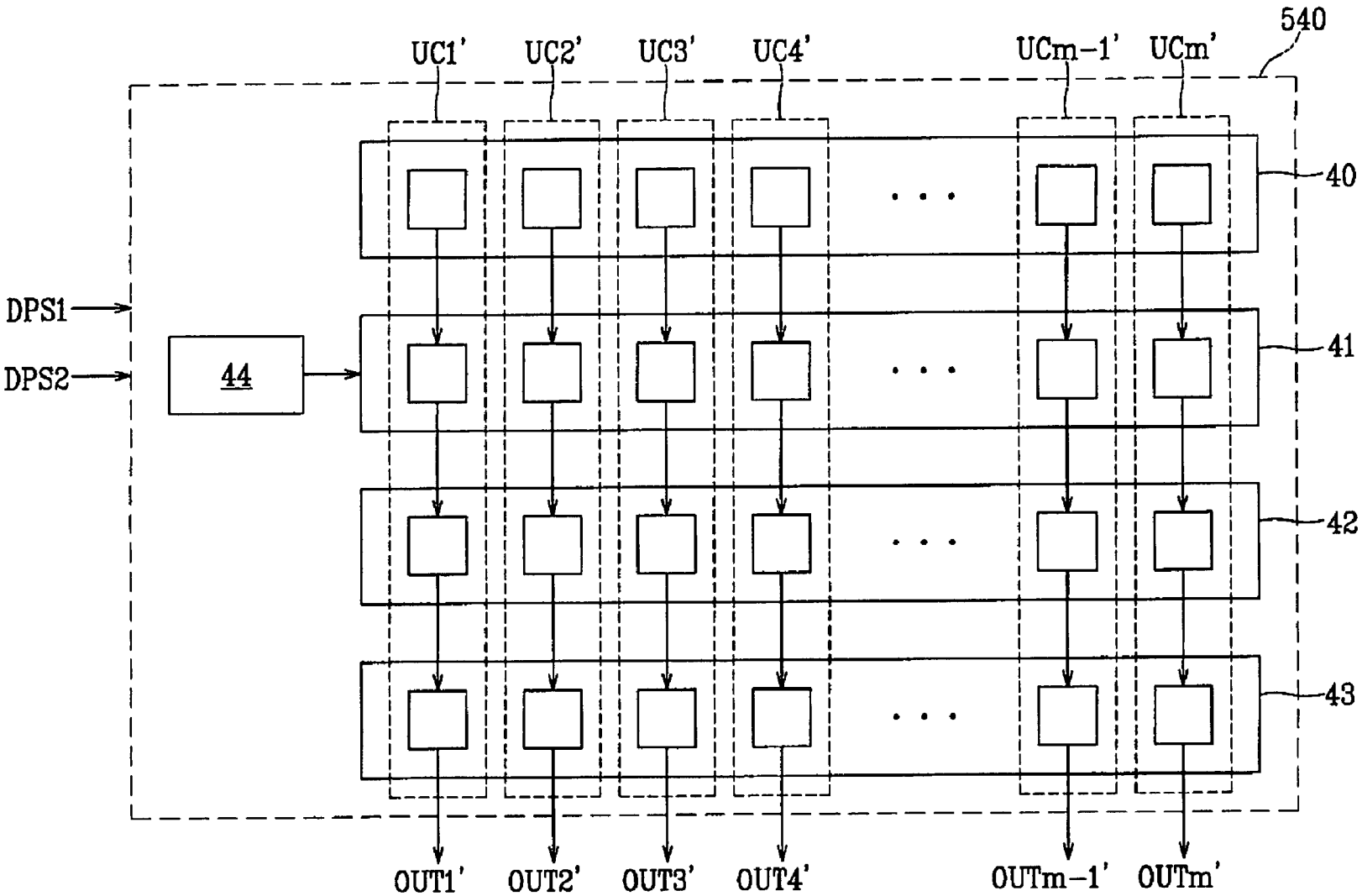
FIG. 4 is a block diagram of a data driving IC according to an exemplary embodiment of the present invention.

FIG. 3 is a block diagram of a gate driving IC according to an exemplary embodiment of the present invention, and FIG. 4 is a block diagram of a data driving IC according to an exemplary embodiment of the present invention.

As shown in FIG. 3, a gate driving IC 440 according to an exemplary embodiment of the present invention includes a plurality of unit circuits UC1 to UCm. A number of the unit circuits UC1 to UCm are enabled in response to gate pin selecting signals GPS1 and GPS2. A state of the gate pin selecting signals GPS1 and GPS2 is set to correspond to a resolution of the display device. Thus, the number of the unit circuits UC1 to UCm generating gate-on voltages $V_{on}$ via output terminals OUT1 to OUTm varies in response to the state of the gate pin selecting signals GPS1 and GPS2. Each output terminal has a plurality of output pins. Therefore, a number of output pins enabled also varies in response to the state of the gate pin selecting signals GPS1 and GPS2. The gate driving IC 440 may be a shift register having a plurality of stages (corresponding to each unit circuit), for example.

As shown in FIG. 3, when two gate pin selecting signals GPS1 and GPS2 are applied to the gate driving IC 440, a number of states possible to select is 4 ($=2^2$). Thus, a number of output pins enabled may be selected from one of four possible choices corresponding to each possible state. For example, when the total number of output pins of the gate driving IC 440 is 400, and, if the gate pin selecting signals GPS1 and GPS2 are in the state of "00" and "01", the gate-on voltage $V_{on}$ is transmitted through 342 and 350 output pins, respectively. Further, if the gate pin selecting signals GPS1 and GPS2 are in the state of "10" and "11", the gate-on voltage $V_{on}$ is transmitted through 384 and 400 output pins, respectively.

An example of resolution of display devices, the state of the gate pin selecting signals GPS1 and GPS2 and a number of needed gate driving ICs 440 is shown in table 1.

TABLE 1

| Resolution | Gate pin selecting signal(GPS1, GPS2) | The number of gate driving ICs (the number of selected output pins) |
|---|---|---|
| XGA(extended graphics array) (1024 × 768) | 10 | 2 (384) |
| WXGA(wide XGA)(1280 × 800) | 10 | 2 (384) |
| | 11 | 2 (400) |
| SXGA(super XGA)(1280 × 1024) | 00 | 2 (342) |

TABLE 1-continued

| Resolution | Gate pin selecting signal(GPS1, GPS2) | The number of gate driving ICs (the number of selected output pins) |
|---|---|---|
| SXGA+(1400 × 1050)/WSXGA(wide SXGA)+(1680 × 1050) | 01 | 3 (350) |
| UXGA(ultra XGA)(1600 × 1200)/ WUXGA(wide UXGA)(1920 × | 11 | 3 (400) |

Additionally, as shown in FIG. 4, a data driving IC 540 according to an exemplary embodiment of the present invention includes a data register 44, shift registers 40, latches 41, digital to analogue (D/A) converters 42 and output buffers 43.

The data register 44 is supplied with and stores image signals DAT from the signal controller 600 sequentially. The shift register 40 shifts a packet of the image signals DAT stored in the data register 44 based on a shift clock signal (not shown) sequentially and stores in the latches 41. Subsequently, the latches 41 output a packet of the image signals DAT to the D/A converters 42. After converting the image signals DAT into analogue voltages, the D/A converters 42 output the analogue voltages to the output terminals OUT1' to OUTm' connected to the output pins (not shown) via the output buffers 43 as data voltages.

The respective unit circuits UC1' to UCm' of the data driving IC 540 include a portion of the shift registers 40, the latches 41, the D/A converters 42 and the output buffers 43.

In such data driving IC 540, the number of unit circuits UC1'to UCm' enabled in response to a state of the data pin selecting signals DPS1 and DPS2 varies such that the number of output pins transmitting the data voltages varies accordingly.

Like the gate driving IC 440, two data pin selecting signals DPS1 and DPS2 are applied to the data driving IC 540, and accordingly a number of states possible to select is 4 ($=2^2$). Thus, a number of output pins enabled may be selected from one of four possible choices corresponding to each possible state. For example, when a total number of output pins of the data driving IC 540 is 642, if the data pin selecting signals DPS1 and DPS2 are in the state of "00" and "01", the data voltages are transmitted through 600 and 618 output pins, respectively. Further, if the data pin selecting signals DPS1 and DPS2 are in the state of "10" and "11", the data voltages are transmitted through 630 and 642 output pins, respectively.

In this case, an example of resolution of display devices, the state of the data pin selecting signals DPS1 and DPS2 and the number of needed data driving IC 540 is shown in table 2.

| Resolution | Data pin selecting signal(DPS1, DPS2) | The number of data driving ICs (the number of selected pins) |
|---|---|---|
| XGA(1024 × 768) | 01 | 5 (618) |
| WXGA(1280 × 800), SXGA(1280 × 1024) | 11 | 6 (642) |
| SXGA+(1400 × 1050) | 00 | 7 (600) |
| WSXGA+(1680 × 1050) | 10 | 8 (630) |
| UXGA(1600 × 1200) | 00 | 8 (600) |
| WUXGA(1920 × 1200) | 11 | 9 (642) |

Now, a structure of a flat panel display according to an exemplary embodiment of the present invention will be described with reference to FIG. 5.

Figure 5:
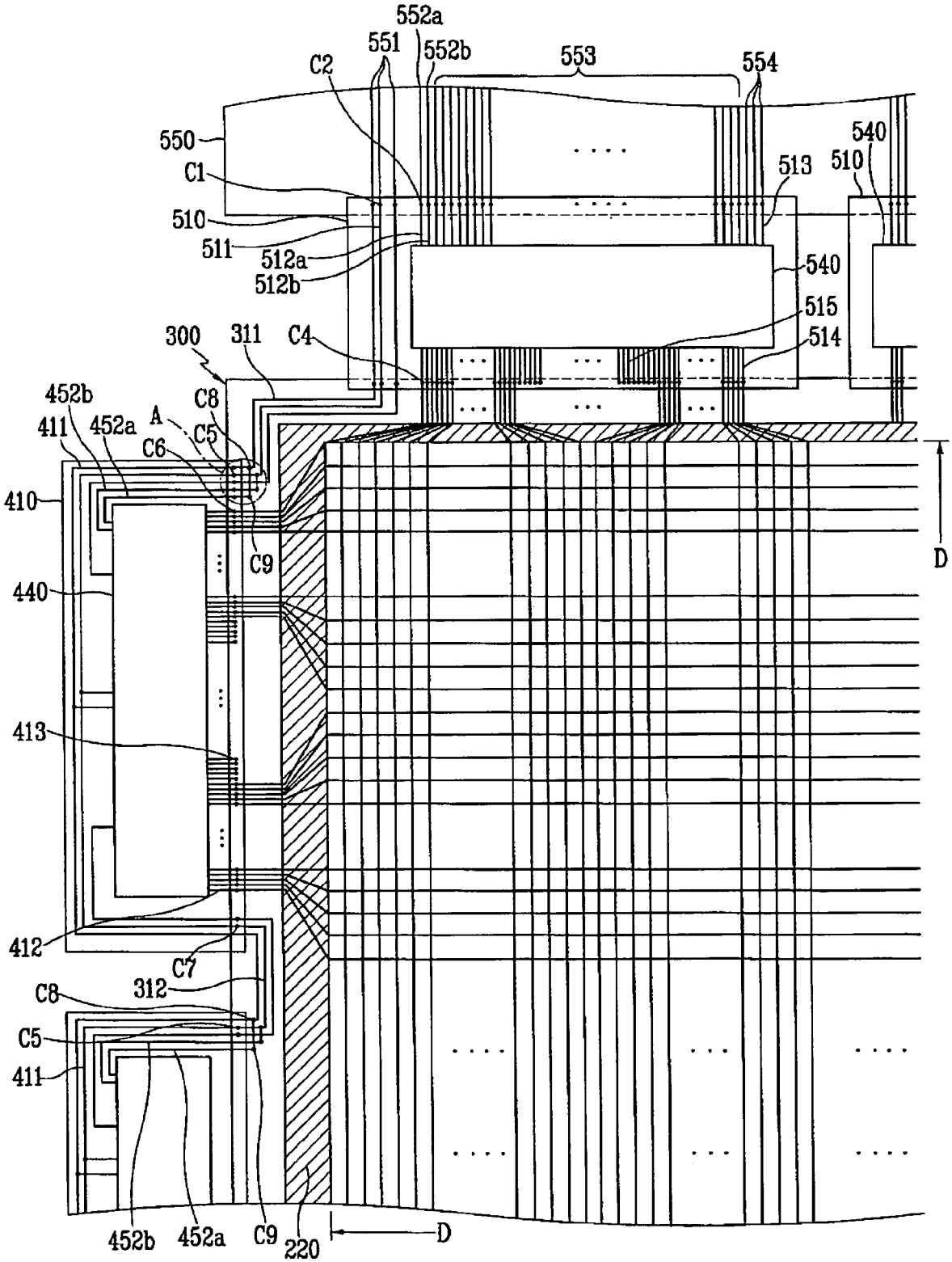
FIG. 5 is a schematic diagram of a display device according to an exemplary embodiment of the present invention.

FIG. 5 is a schematic diagram of a flat panel display according to an exemplary embodiment of the present invention.

As shown in FIG. 5, a printed circuit board (PCB) 550 provided with circuit elements such as the signal controller 600 etc. for driving a display device is located at the top of the panel assembly 300 provided with the gate lines $G_1$-$G_n$ and data lines $D_1$-$D_m$.

A plurality of data tape carrier package boards (TCP) 510 are attached to the top of the panel assembly 300 in a transverse direction, and the data driving IC 540 is mounted on one data TCP 510. The PCB 550 is physically and electrically connected to the panel assembly 300 via the data TCP 510.

Each TCP 510 includes a plurality of data transmission lines 553, first driving signal lines 551 and second driving signal lines 554 and data pin selecting signal lines 552*a* and 552*b* formed thereon. The data transmission lines 553 and driving signal lines 554 are connected to input terminals of each of the data driving ICs 540 via a plurality of input leads 513 provided on the TCP 510.

The second driving signal lines 554 transmit supply voltages and control signals required for operation of the data driving ICs 540 to the data driving ICs 540 via the plurality of input leads 513 provided on the TCP 510. The first driving signal lines 551 transmit supply voltages and control signals required for operation of the gate driving ICs 440 to the gate driving ICs 440 via a plurality of input leads 511 provided on the TCP 510 and a plurality of driving signal lines 311 provided on the panel assembly 300.

Further, the data pin selecting signal lines 552*a* and 552*b* are connected to contacts (not shown) applied with supply voltage or ground voltage via a separate connecting member in response to a predetermined resolution of the display device, thereby transmitting the data pin selecting signals DPS1 and DPS2 corresponding to a state thereof to the data driving ICs 540.

The first and second driving signal lines 551 and 554, the data pin selecting signal lines 552*a* and 552*b* and the data transmission lines 553 are connected to input leads 511, 512*a*, 512*b* and 513 at contacts C1 and C2. In other words, the first driving signal lines 551 are connected to the input leads 511 at the contact C1, and the second driving signal lines 554 and the data transmission lines 553 are connected to the input leads 512*a*, 512*b* and 513 at the contact C2.

The remaining TCPs 510 include a separate set of first and second driving signal lines 551 and 554, data transmission lines 553, and data pin selecting signal lines 552*a* and 552*b* formed thereon, which transmit driving signals, control signals, data signals and the data pin selecting signals DPS1 and DPS2 to the data driving ICs 540 connected thereto.

The first and second driving signal lines 551 and 554, the data pin selecting signal lines 552*a*, 552*b*, and the data transmission lines 553 are connected to circuit elements on the PCB 550 and receive signals therefrom. The first driving signal lines 551 may be provided on a separate FPC film (not shown).

A number of input pins and output pins (not shown) of the data driving ICs 540 may be the same as a number of the input leads 512*a*, 512*b* and 513 and output leads 514 and 515, and each pin is connected to a corresponding lead.

Accordingly, since the output pins of the data driving ICs and the output leads 514 and 515 maintain contact when the data lines $D_1$-$D_m$ are connected to the output leads 514 and 515 formed on the data TCP 510 in the process of manufacturing the panel assembly 300, users connect the data lines $D_1$-$D_m$ to the output leads 514 only corresponding to the number of the output pins selected depending on the data pin selecting signals DPS1 and DPS2 and do not connect the data lines $D_1$-$D_m$ to the remaining output leads 515. Although it is shown in FIG. 5 that centrally located output leads 515 are not connected to the data lines $D_1$-$D_m$, positions of the output leads 515 not connected to the data lines $D_1$-$D_m$ may differ. Furthermore, although it is shown in FIG. 5 that only the output leads 514 of the data driving ICs 540 are connected to the data lines $D_1$-$D_m$ and the remaining output leads 515 are not connected to the data lines $D_1$-$D_m$, it is obvious that any of the output leads 514 and 515 may be connected to the data lines $D_1$-$D_m$.

Gate TCPs 410 are attached to a side edge of the panel assembly 300 in a longitudinal direction, which include gate driving ICs 440 mounted thereon. Each gate TCP 410 includes a plurality of gate leads 412 and 413, a plurality of gate driving signal lines 411 and gate pin selecting signal lines 452*a* and 452*b* formed thereon. A number of the gate driving signal lines 411 may be substantially more than that shown in FIG. 5.

The gate driving signal lines 411 are electrically connected to the driving signal lines 311 disposed on top and left edges external to a display area D of the panel assembly 300 via contacts C5, and remaining gate driving signal lines 411 are connected to gate driving signal lines 312 disposed between external sides of the display area D and the gate TCP 410 via the contacts C7 to be connected to the gate driving signal lines 411 provided on adjacent gate TCPs 410 via the contacts C5.

The gate pin selecting signal lines 452*a* and 452*b* are connected to the driving signal lines 311 supplied with supply voltage or ground voltage via contacts C6, C8 and C9 depending on a predetermined resolution of the display device to transmit the gate pin selecting signals GPS1 and GPS2 of a corresponding state to the gate driving ICs 440. Such connection of the gate driving signal lines 452*a* and 452*b* will be described in detail later.

The number of the output pins (not shown) of the gate driving ICs 440 is same as a number of gate leads 412 and 413 provided on the corresponding gate TCP 410 and the output pins thereof are connected to corresponding gate leads 412 and 413.

Accordingly, when the gate lines $G_1$-$G_n$ are in contact with the gate leads 412 and 413 provided on the gate TCP 410 via the contacts C6, users connect the gate lines $G_1$-$G_n$ to the gate leads 412 only corresponding to the number of the output pins selected depending on the gate pin selecting signals GPS1 and GPS2 and do not connect the gate lines $G_1$-$G_n$ to the remaining gate leads 413. Although it is shown in FIG. 5 that centrally located gate leads 413 are not connected to the gate lines $G_1$-$G_n$, positions of the gate leads 413 not connected to the gate lines $G_1$-$G_n$ may differ. Furthermore, although it is shown in FIG. 5 that only the gate leads 412 of the gate driving ICs 440 are connected to the gate lines $G_1$-$G_n$, it is obvious that any of the gate leads 412 and 413 may be connected to the gate lines $G_1$-$G_n$.

As shown in FIG. 5, a plurality of pixel areas defined by the intersections of the gate lines $G_1$-$G_n$ and the data lines $D_1$-$D_m$ provided on the panel assembly 300 form the display area D. A black matrix 220 (indicated by hatched area) for blocking light leakage exterior to the display area D is provided around the display area D. Although the gate lines $G_1$-$G_n$ or the data lines $D_1$-$D_m$ extend substantially parallel to each other in the display area D, the gate lines $G_1$-$G_n$ and the data lines $D_1$-$D_m$ close each other while traversing the black matrix 220 and then become parallel again while extending away from the display area D.

As described above, in an LCD, the panel assembly 300 includes the lower and upper panels 100 and 200, and one of the lower and upper panels 100 and 200 is provided with the thin film transistors (TFTs) and is called a "TFT array panel." The driving signal lines 311 and 312 are provided on the TFT array panel.

An exemplary TFT array panel for an LCD according to an exemplary embodiment of the present invention is now described in detail with reference to FIGS. 5 to 9.

Figure 6:
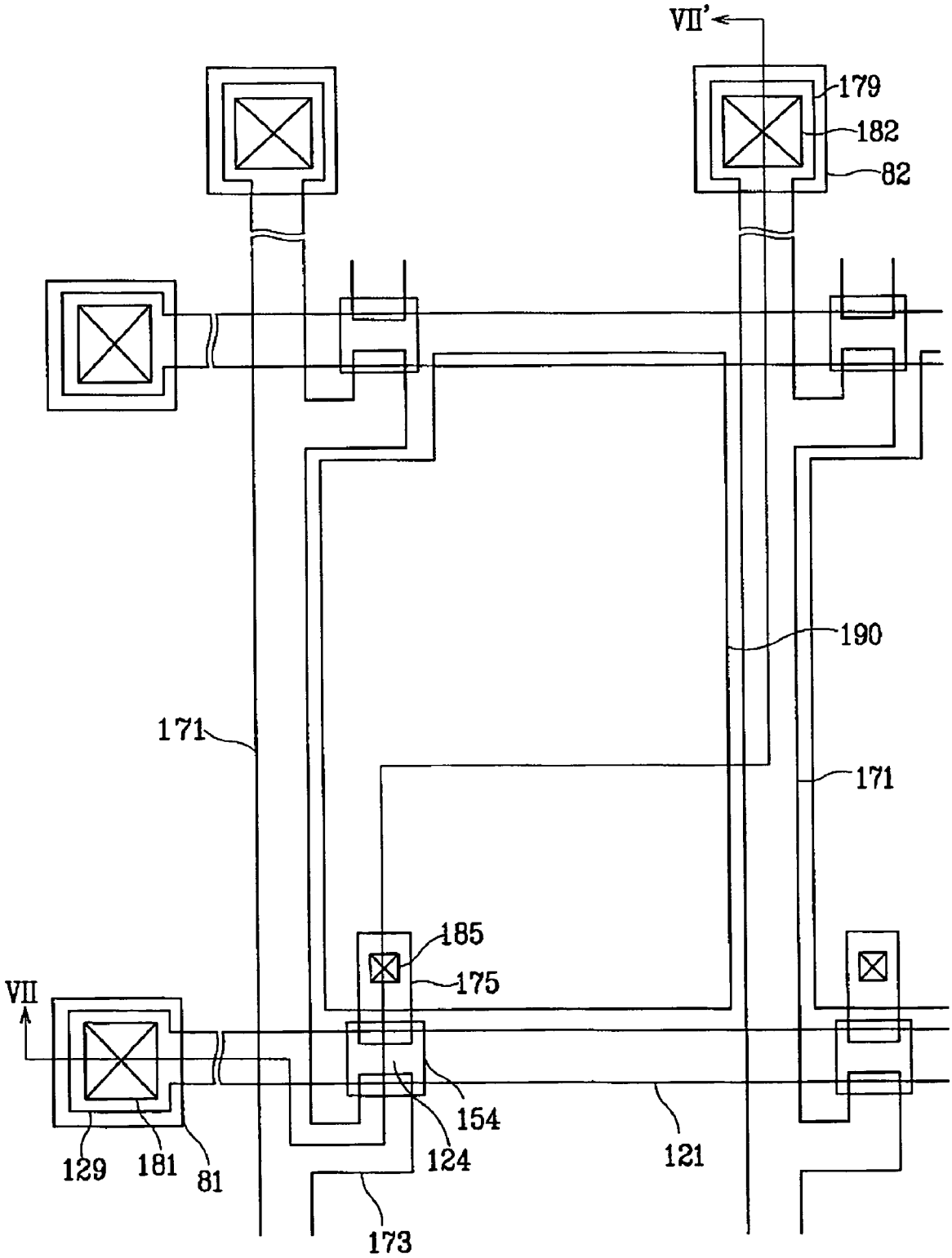
FIG. 6 is a layout view of a thin film transistor array panel for a liquid crystal display according to an exemplary embodiment of the present invention.
Figure 7:
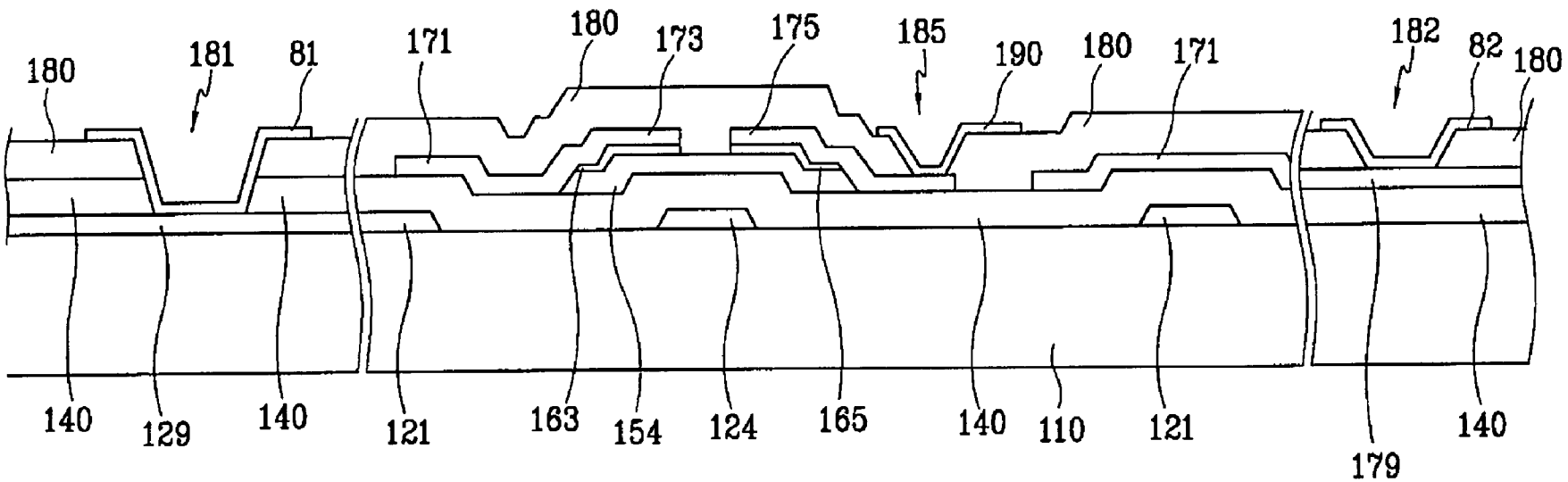
FIG. 7 is a sectional view taken along line VII-VII' in FIG. 6.
Figure 8:
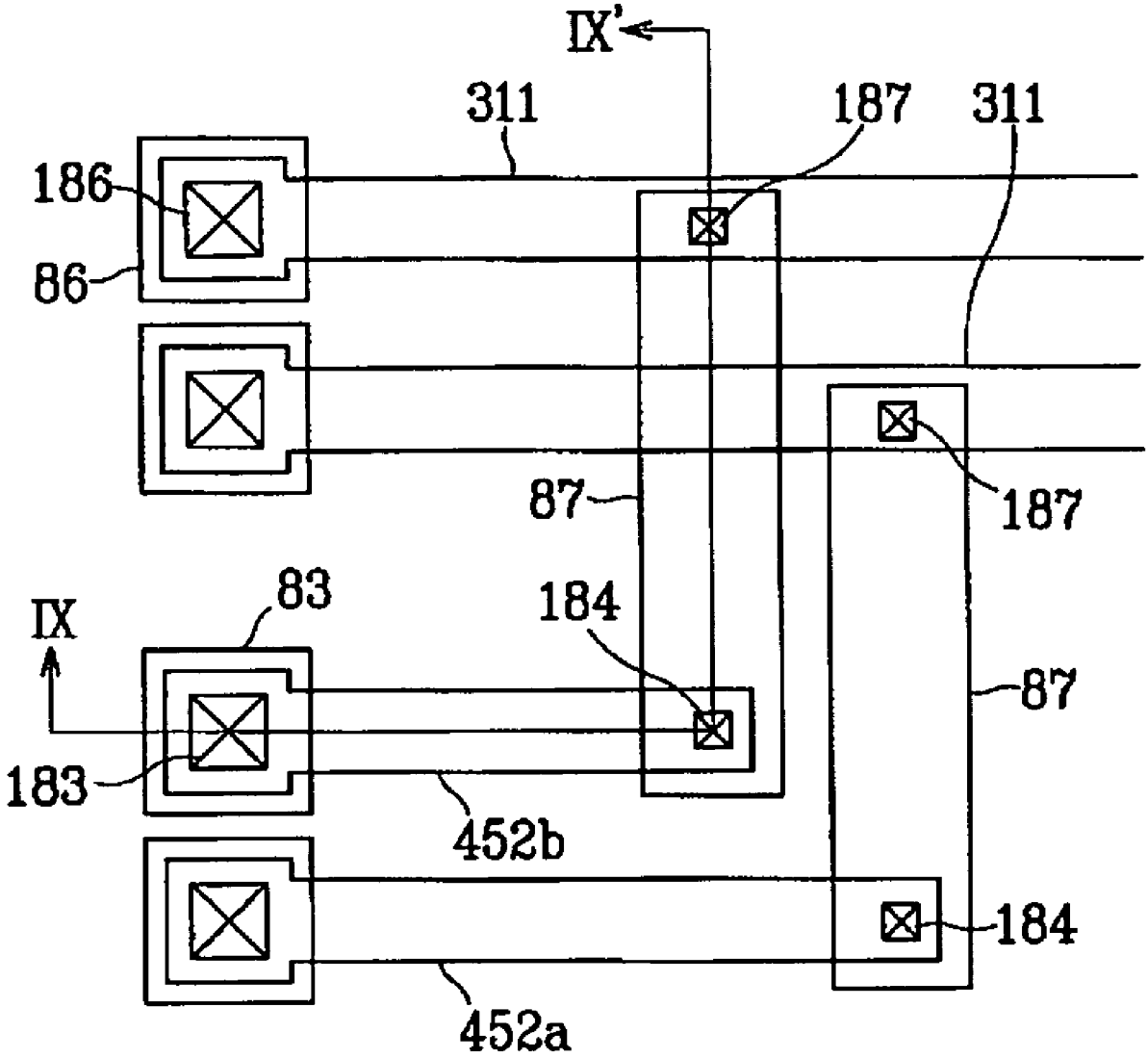
FIG. 8 is an enlarged layout view of portion A in FIG. 5, and is to illustrate connection relation of a gate driving signal line and a gate pin selecting signal.
Figure 9:
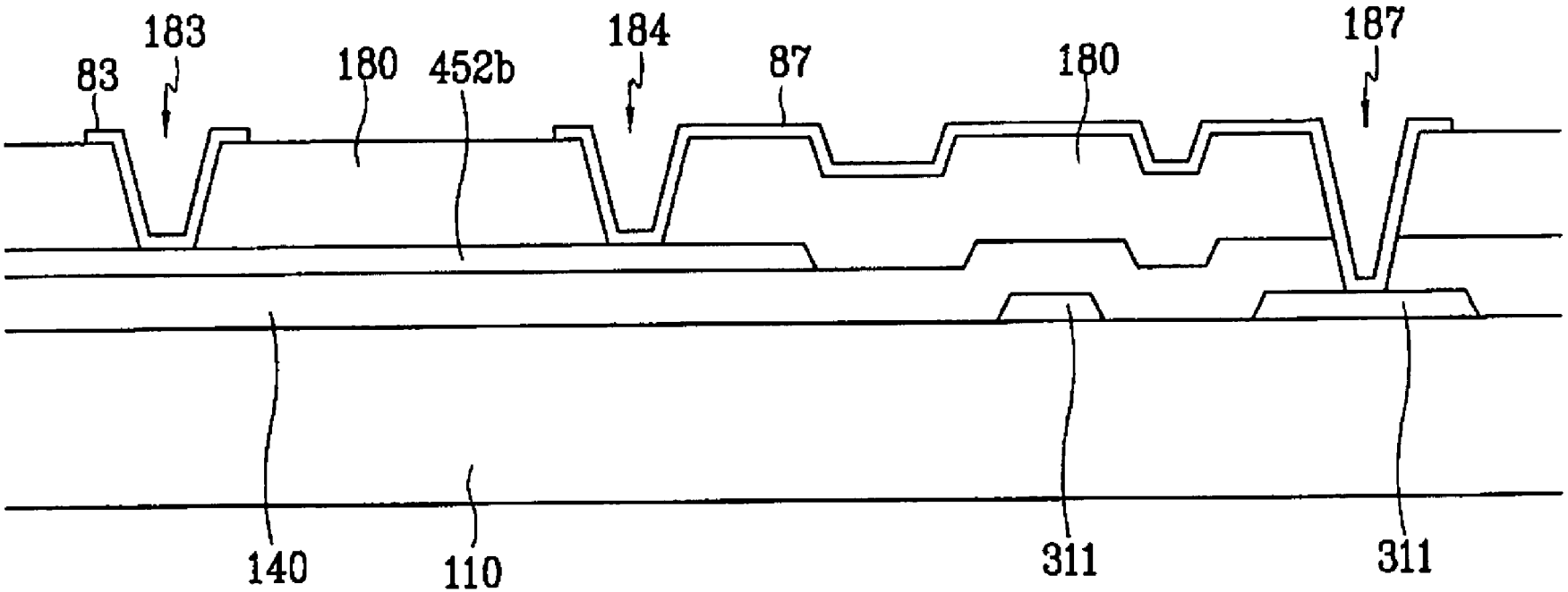
FIG. 9 is a section view taken along line IX-IX' in FIG. 8.

FIG. 6 is a layout view of a TFT array panel for an LCD according to an exemplary embodiment of the present invention. FIG. 6 shows an enlarged view of gate lines, data lines and the intersections of the gate and data lines. FIG. 7 is a sectional view of the TFT array panel shown in FIG. 6 taken along line VII-VII'. FIG. 8 is an enlarged partial view of portion A in FIG. 5 according to an exemplary embodiment of the present invention, which illustrates a relation of a connection of gate driving signal lines and gate pin selecting signal lines. FIG. 9 is a sectional view taken along line IX-IX' in FIG. 8.

Referring to FIGS. 6-9, a plurality of gate lines 121 and a plurality of driving signal lines 311 are formed on an insulating substrate 110. The gate lines 121 extend substantially in a transverse direction to transmit gate signals and are spaced apart from each other.

A portion of each gate line 121 forms a gate electrode 124. Each gate line 121 further includes an end portion 129 for contact with another layer or a driving circuit. Each end portion 129 is located at the contacts C6 in FIG. 5 and is connected to the gate leads 412 of the gate TCP 410 by an anisotropic conductive film etc. The gate lines 121 may extend to be connected to a driving circuit that may be integrated on the TFT array panel.

The driving signal lines 311 extend in a transverse direction around an edge of the panel assembly 300 and thereafter extend in a longitudinal direction around an upper corner and then extend in the transverse direction, again. Each driving signal line 311 is located at the contacts C5 in FIG. 5 and includes an end portion.

The gate lines 121 and the gate driving signal lines 311 are preferably made of Al containing metal such as Al and Al alloy, Ag containing metal such as Ag and Ag alloy, Cu containing metal such as Cu and Cu alloy, Mo containing metal such as Mo and Mo alloy, Cr, Ti or Ta. The gate lines 121 and the driving signal lines 311 may have a multi-layered structure including two films having different physical characteristics. One of the two films is preferably made of a low resistivity metal including Al containing metal, Ag containing metal, and Cu containing metal for reducing signal delay or voltage drop in the gate lines 121 and the driving signal lines 311. The other film is preferably made of material such as a Mo containing metal, Cr, Ta or Ti, which have good physical, chemical, and electrical contact characteristics with other materials such as indium tin oxide (ITO) or indium zinc oxide (IZO). Examples of combinations of the two films are a lower Cr film and an upper Al (alloy) film and a lower Al (alloy) film and an upper Mo (alloy) film. However, the two films may be made of various metals or conductors.

The lateral sides of the gate lines 121 and the driving signal lines 311 are inclined relative to a surface of the substrate creating inclination angles, and the inclination angles are in a range of about 20 degrees to about 80 degrees.

A gate insulating layer 140 preferably made of silicon nitride (SiNx) is formed on the gate lines 121 and the driving signal lines 311.

Semiconductor islands 154 preferably made of hydrogenated amorphous silicon (a-Si) are formed on a gate insulating layer 140. Pairs of ohmic contacts 163 and 165 are formed on the semiconductor islands 154. The pairs of ohmic contacts 163 and 165 preferably include silicide or hydrogenated a-Si heavily doped with n type impurity, and each contact of the pairs of ohmic contacts 163 and 165 is separated by the gate electrode 124. Lateral sides of the semiconductor islands 154 and the pairs of ohmic contacts 163 and 165 are inclined relative to a surface of the insulating substrate 110, and the inclination angles thereof are preferably in a range of about 30 degrees to about 80 degrees.

Data lines 171, drain electrodes 175 spaced apart from the data lines 171 and gate pin selecting signal lines 452*a* and 452*b* are formed on the pairs of ohmic contacts 163 and 165 and the gate insulating layer 140.

The data lines 171 extend substantially in the longitudinal direction to transmit data voltages and intersect the gate lines 121. Each data line 171 includes an end portion 179 and source electrodes 173 projecting toward the drain electrodes 175. The end portions 179 are located at the contacts C4 in FIG. 5 and are connected to the output leads 514 of the data TCP 510 by an anisotropic conductive film.

Each pair of source and drain electrodes 173 and 175 are disposed opposite each other with respect to the gate electrode 124. The gate electrode 124, a source electrode 173, and a drain electrode 175 along with a semiconductor island 154 form a TFT having a channel formed in the semiconductor island 154 disposed between the source electrode 173 and the drain electrode 175.

The gate pin selecting signal lines 452*a* and 452*b* extend substantially in the transverse direction to transmit the gate pin selecting signals GPS1 and GPS2 to the gate driving ICs 440. Each gate pin selecting signal line 452*a* and 452*b* includes an end portion. Each end portions is located at the contacts C6 and is connected to the gate pin selecting signal lines 452*a* and 452*b* by an anisotropic conductive film. The gate pin selecting signal lines 452*a* and 452*b* may be formed at the same layer as the gate lines 121 and the driving signal lines 311 and 312 may be formed at the same layer as the data lines 171.

The data lines 171 and the drain electrodes 175 and the gate pin selecting signal lines 452*a* and 452*b* are preferably made of refractory metal such as Cr, Mo, Ti, Ta or alloys thereof. However, the data lines 171 and the drain electrodes 175 and the gate pin selecting signal lines 452*a* and 452*b* may have a multilayered structure including a low-resistivity film (not shown) and a good-contact film (not shown). Examples of the multi-layered structure include a double-layered structure having a lower Cr film and an upper Al (alloy) film, a double-layered structure having a lower Mo (alloy) film and an upper Al (alloy) film, and a triple-layered structure having a lower Mo film, an intermediate Al film, and an upper Mo film.

Like the gate lines 121, the data lines 171, the drain electrodes 175 and the gate pin selecting signal lines 452*a* and 452*b* have inclined edge profiles, and the inclination angles thereof are in a range of about 30 degrees to about 80 degrees.

Each pair of ohmic contacts 163 and 165 is disposed between the underlying semiconductor island 154 and the overlying source and drain electrodes 173 and 175 and reduce a contact resistance between the semiconductor island 154 and the source and drain electrodes 173 and 175.

A passivation layer 180 is formed on the data lines 171 and the source and drain electrodes 173 and 175, and the exposed portions of the semiconductor island 154. The passivation layer 180 is preferably made of an inorganic insulator such as silicon nitride or silicon oxide, a photosensitive organic material having a good flatness characteristic, or a low dielectric insulating material having a dielectric constant lower than 4.0 such as a-Si:C:O and a-Si:O:F formed by plasma enhanced chemical vapor deposition (PECVD). The passivation layer 180 may have a double-layered structure including a lower inorganic film to protect the exposed portions of the semiconductor island 154 and an upper organic film.

The passivation layer 180 has a plurality of contact holes 182, 185, 183 and 184 exposing the end portions 179 of the data lines 171, a portion of the drain electrodes 175, and end portions and other portions of the gate pin selecting signal lines 452*b*, respectively.

The passivation layer 180 and the gate insulating layer 140 have a plurality of contact holes 181, 186 and 187 exposing the end portions 129 of the gate lines 121, and end portions and other portions of the driving signal lines 311, respectively. Furthermore, although not shown in figures, the passivation layer 180 and the gate insulating layer 140 also have contact holes exposing a portion of the driving signal lines 312.

A plurality of pixel electrodes 190 and a plurality of contact assistants 81, 82, 83 and 86 and connections 87 which are preferably made of a transparent conductor such as ITO or IZO or reflective conductor such as Ag or Al, are formed on the passivation layer 180.

The pixel electrodes 190 are physically and electrically connected to the drain electrodes 175 through the contact holes 185 such that the pixel electrodes 190 receive the data voltages from the drain electrodes 175.

Referring now to FIG. 2, electric fields are generated between the pixel electrode 190 supplied with the data voltages and the common electrode 270 supplied with the common voltage, which determine an orientation of liquid crystal molecules in the LC layer 3.

Referring again to FIGS. 5-9, the contact assistants 81, 82, 83 and 86 are connected to and cover the end portions 129 of the gate lines 121, the end portions 179 of the data lines 171, the end portions of the gate pin selecting signal lines 452*b* and the end portions of the driving signal lines 311 through the contact holes 181, 182, 183 and 186, respectively. The contact assistants 81, 82, 83 and 86 protect the end portions 129 and 179 and the end portions of the gate pin selecting signal lines 452*b* and the end portions of the driving signal lines 311 and complement the adhesion of the end portions 129 and 179 and the end portions of the gate pin selecting signal lines 452*b* and the end portions of the driving signal lines 311 and external devices.

The connections 87 are connected to the driving signal lines 311 through the contact holes 187 and are connected to the gate pin selecting signal lines 452*a* and 452*b* through the contact holes 184. Accordingly, supply voltages or ground voltages transmitted via the driving signal lines 311 are applied to the gate pin selecting signal lines 452*a* and 452*b* as the gate pin selecting signals.

Now, operation of the above-described display device will be described in detail.

The signal controller 600 is supplied with input image signals R, G and B and input control signals including a vertical synchronization signal Vsync, a horizontal synchronization signal Hsync, a main clock MCLK, and a data enable signal DE, from an external graphics controller (not shown). After generating gate control signals CONT1 and data control signals CONT2 and processing the input image signals R, G and B suitable for the operation of the panel assembly 300 on the basis of the input control signals and the input image signals R, G and B, the signal controller 600 transmits the gate control signals CONT1 to the gate driver 400, and the processed image signals DAT and the data control signals CONT2 to the data driver 500.

The gate control signals CONT1 include a scanning start signal STV for instructing the gate driver 400 to start scanning and a gate clock signal CPV for controlling the output time of the gate-on voltage $V_{on}$. The gate control signals CONT1 may further include an output enable signal OE for defining the duration of the gate-on voltage $V_{on}$.

The data control signals CONT2 include a horizontal synchronization start signal STH for informing the data driver 500 of a start of data transmission for a group of pixels, a load signal LOAD for instructing the data driver 500 to apply the data voltages to the data lines $D_1$-$D_m$, and a data clock signal HCLK. The data control signal CONT2 may further include an inversion signal RVS for reversing the polarity of the data voltages (with respect to the common voltage $V_{com}$).

According to the exemplary embodiments of the present invention, the gate and data pin selecting signals GPS1, GPS2, DPS1 and DPS2 have signal levels determined depending on a resolution of a display device. The gate and data pin selecting signals GPS1, GPS2, DPS1 and DPS2 are transmitted to corresponding gate driving ICs 440 and data driving ICs 540 via gate pin selecting signal lines 452*a* and 452*b* and data pin selecting signal lines 552*a* and 552*b*, respectively. However, a number of bits of such signals or a number of the gate and data pin selecting signal lines 452*a*, 452*b*, 552*a* and 552*b* transmitting the gate and data pin selecting signals GPS1, GPS2, DPS1 and DPS2 may be varied.

The data driving IC 540 changes operational states depending on the data pin selecting signals DPS1 and DPS2. For example, after receiving the data pin selecting signals DPS1 and DPS2 having a state corresponding to a resolution of the display device, the data driving IC 540 enables a number of the unit circuits UC1'to UCm' corresponding to the state of the data pin selecting signals DPS1 and DPS2. The data driving IC 540 stores the image signals DAT to the data register 44 sequentially and thereafter shifts the stored image signals DAT to the latches 41 of only enabled unit circuits UC1'to UCm' responsive to operation of the shift registers 40, thereby storing a packet of the image signals DAT thereto. Subsequently, the latches 41 output the stored image signals DAT to the D/A converts 42 responsive to the load signal LOAD, and the D/A converters 42 convert the image signals DAT into analogue voltages, and thereafter output the data voltages to the output terminals OUT1'to OUTm' via the output buffers 43. Therefore, the data voltages are applied to the data lines $D_1$-$D_m$ via output leads 514 connected to the output pins. In this case, since the disabled unit circuits of the data driving IC 540 do not perform such operations, the output pins thereof do not output the data voltages.

The gate driving IC 440 according to an exemplary embodiment of the present invention changes operational states depending on the gate pin selecting signals GPS1 and GPS2. For example, after receiving the gate pin selecting signals GPS1 and GPS2 having a state corresponding to a resolution of the display device, the gate driving IC 440 enables a number of unit circuits UC1 to UCm corresponding to the state of the gate pin selecting signals GPS1 and GPS2. Responsive to the gate control signals CONT1 from the signal controller 600, the gate driving IC 400 applies the gate-on voltages $V_{on}$ to the gate lines $G_1$-$G_n$ via only the output pins of the enabled unit circuits UC1 to UCm sequentially to turn on the switching elements Q connected thereto. Accordingly, the data voltages applied to the data lines $D_1$-$D_m$ are supplied to the corresponding pixels via the turned-on switching elements Q.

A difference between the data voltage and the common voltage $V_{com}$ is represented as a voltage across the LC capacitor $C_{LC}$, which is referred to as a pixel voltage. The LC molecules in the LC capacitor $C_{LC}$ have orientations depending on a magnitude of the pixel voltage, and molecular orientations of the LC molecules determine a polarization of light passing through the LC layer 3. A polarizer(s) converts light polarization into a light transmittance.

By repeating this procedure by a unit of a horizontal period (which is indicated by 1 H and equal to one period of the horizontal synchronization signal Hsync), all gate lines $G_1$-$G_n$ are sequentially supplied with the gate-on voltage $V_{on}$ during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (which is called "column inversion" or "dot inversion"), or the polarity of the data voltages in one packet are reversed (which is called "row inversion" or "dot inversion").

The present invention can be also employed to other display devices such as OLED.

The above-described structure and driving scheme according to the embodiment of the present invention provide the driving ICs possible to be used irrespective of resolution of a display device.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. A driving circuit comprising:

an input terminal;

unit circuits connected to the input terminal; and output terminals electrically connected to the input terminal, wherein each of the unit circuits comprises a plurality of output pins and a selected number of the output pins of the unit circuits is enabled in response to a control signal inputted via the input terminal and the control signal is a signal having two bits, wherein the number of the output pins is larger than the number of gate lines of a display devise connected to the driving circuit.

2. The driving circuit of claim 1, wherein the driving circuit is a gate driving integrated circuit.

3. The driving circuit of claim 2, wherein the gate driving integrated circuit comprises 400 output pins.

4. The driving circuit of claim 3, wherein the selected number of enabled output pins is one of 342, 350, 384 and 400.

5. The driving circuit of claim 1, wherein the gate driving integrated circuit comprises 642 output pins, and a selected number of output pins are enabled in response to the control signal.

6. The driving circuit of claim 5, wherein the selected number of enabled output pins is one of 600, 618, 630 and 642.

7. The driving circuit of claim 1, wherein each of the unit circuits comprises a portion having a shift register, a latch, a digital to analogue converter and an output buffer.

8. A driving circuit comprising: unit circuits including a plurality of output pins, wherein a part of output pins are used and the other part of output pins are not used and the number of the output pins is larger than the number of gate lines of a display device connected to the driving circuit.

9. The driving circuit of claim 8, further comprising output terminals, wherein the output pins of the unit circuit are electrically connected to the output terminals.

* * * * *